US007484714B1

(12) United States Patent
Tsai

(10) Patent No.: US 7,484,714 B1
(45) Date of Patent: Feb. 3, 2009

(54) CHARGEABLE ELECTRIC WINCH

(75) Inventor: Chi-Jung Tsai, Tapei County (TW)

(73) Assignee: Chizong Machine Co., Ltd., Taipei County ( * ) Notice: Subject to any disclaimer, the term of this patent is extended or adjusted under 35 U.S.C. 154(b) by 0 days.

(21) Appl. No.: 11/976,634

(22) Filed: Oct. 26, 2007

(51) Int. Cl.
*B66D 1/14* (2006.01)

(52) U.S. Cl. ..... 254/343; 320/114; 318/432; 81/57.13

(58) Field of Classification Search ..... 254/342, 254/343, 362; 320/107, 114; 318/432; 81/57.11, 81/57.13; 173/49; 429/99, 100
See application file for complete search history.

(56) References Cited

U.S. PATENT DOCUMENTS 4,712,983 A * 12/1987 Moynihan ..... 417/234
4,751,452 A * 6/1988 Kilmer et al. ..... 320/106
4,874,296 A * 10/1989 Moynihan ..... 417/234
5,954,458 A * 9/1999 Lee ..... 408/16
6,311,787 B1 * 11/2001 Berry et al. ..... 173/176
6,739,221 B2 * 5/2004 Cha ..... 81/57.13
7,112,934 B2 * 9/2006 Gilmore ..... 318/432
7,176,656 B2 * 2/2007 Feldmann ..... 320/114
7,306,049 B2 * 12/2007 Soika et al. ..... 173/49
7,311,025 B1 * 12/2007 Wilson, Jr. ..... 81/429

* cited by examiner

*Primary Examiner*—Emmanuel M Marcelo

(57) ABSTRACT

A chargeable electric winch for driving a to-be-controlled object to rotate. The electric winch includes a housing, a driving device, a driven shaft, a first switch and a battery. The driving device is disposed in the housing. The driven shaft penetrates through the housing and is driven by the driving device to rotate. The first switch is disposed on the housing and has a controller. The controller has an opposite connector and is electrically connected to the driving device. The battery has an inner battery body and an outer connector electrically connected to the inner battery body. The battery for providing power is electrically connected to the opposite connector of the first switch through the outer connector of the battery, and the battery is separatably assembled with the housing.

10 Claims, 7 Drawing Sheets

CHARGEABLE ELECTRIC WINCH

BACKGROUND OF THE INVENTION (1) Field of the Invention

The invention relates to a chargeable electric winch, and more particularly to a portable winch using a chargeable battery so that the winch can be used at a place where no power can be obtained or the power cannot be easily obtained. For example, the chargeable electric winch can be used to spread a canvas of a sailing boat and to put the canvas of the sailing boat together, or to hang a heavy object in the farm.

(2) Description of the Prior Art

At a place where no power can be obtained or the power cannot be easily obtained, a winch is typically driven by a hand of a user in a time-consuming and labor-consuming manner. The following examples will be described.

In a first example for a water activity, the winch has to be used on a sailing boat or a yacht in order to coil and uncoil a cable, to spread a canvas and to put the canvas together, and to change the moving direction of the canvas. However, the power cannot be obtained or cannot be easily obtained on the sailing boat or the yacht, and the manual winch is usually used to control these operations so that these operations are time-consuming and labor-consuming operations.

In a second example for a land activity, the winch has to be used in a high mountain, in a forest or in a farm to hang up a heavy object, to move the heavy object away or to coil and uncoil the heavy object. Because the power cannot be obtained or cannot be easily obtained in the high mountain, the forest or the farm, and the manual winch is usually used to control these operations so that these operations are time-consuming and labor-consuming operations. The land activity also has the problem that the power cannot be obtained or the power cannot be easily obtained. In addition, a net in a tennis court is usually lifted up and lowered down by the manual winch.

Thus, it is an important subject of the invention to provide a chargeable electric winch capable of solving the above-mentioned problems in a reasonable and effective manner.

SUMMARY OF THE INVENTION

It is therefore an object of the invention to provide a chargeable electric winch, which is portable and uses a chargeable battery so that the chargeable electric winch can be conveniently carried and operated. In addition, the battery makes the winch be used at a place where no power can be obtained or the power cannot be easily obtained so that the timesaving and laborsaving effects can be obtained as compared with the conventional manual winch.

Another object of the invention is to provide a chargeable electric winch having a battery which is separatably assembled with a housing so that the battery can be replaced with another backup battery. More particularly, a connector can be connected to an opposite connector as the battery is assembled with the housing so that the battery can provide the power through the connectors.

Still another object of the invention is to provide a chargeable electric winch having a driven shaft which may be combined with different opposite elements according to different requirements. The light emitting angle of the lighting element is configured such that the light is emitted toward a free end of the driven shaft. Thus, the better illumination effect may be obtained. In addition, the position of the handle is close to the driven shaft so that the orientation of the free end of the driven shaft can be controlled more conveniently and more precisely.

To achieve the above-identified objects, the invention provides a chargeable electric winch for driving a to-be-controlled object to rotate. The electric winch includes a housing, a driving device, a driven shaft, a first switch and a battery. The driving device is disposed in the housing. The driven shaft penetrates through the housing and is driven by the driving device to rotate. The first switch is disposed on the housing and has a controller. The controller has an opposite connector and is electrically connected to the driving device. The battery has an inner battery body and an outer connector electrically connected to the inner battery body. The battery for providing power is electrically connected to the opposite connector of the first switch through the outer connector of the battery, and the battery is separatably assembled with the housing.

The invention has the following advantages. The chargeable electric winch of the invention is portable and can thus be carried and operated conveniently. The electric winch of the invention is powered by the chargeable battery so that the electric winch can be used at a place where no power can be obtained or the power cannot be easily obtained, and the timesaving and laborsaving effects can be obtained as compared with the conventional manual winch. The driven shaft can be connected to different opposite elements according to the actual requirement. The light emitting angle of the lighting element is configured such that the light is emitted toward the free end of the driven shaft. Thus, the better illumination effect may be obtained. The position of the handle is close to the driven shaft so that the orientation of the free end of the driven shaft can be controlled more conveniently and more precisely. The battery is configured to be separatably assembled with the second end portion of the housing so that the battery can be replaced with another backup battery. More particularly, the connection between the outer connector and the opposite connector can achieve the effect of creating the electrical connection between the outer connector and the opposite connector when the battery is assembled with the second end portion.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
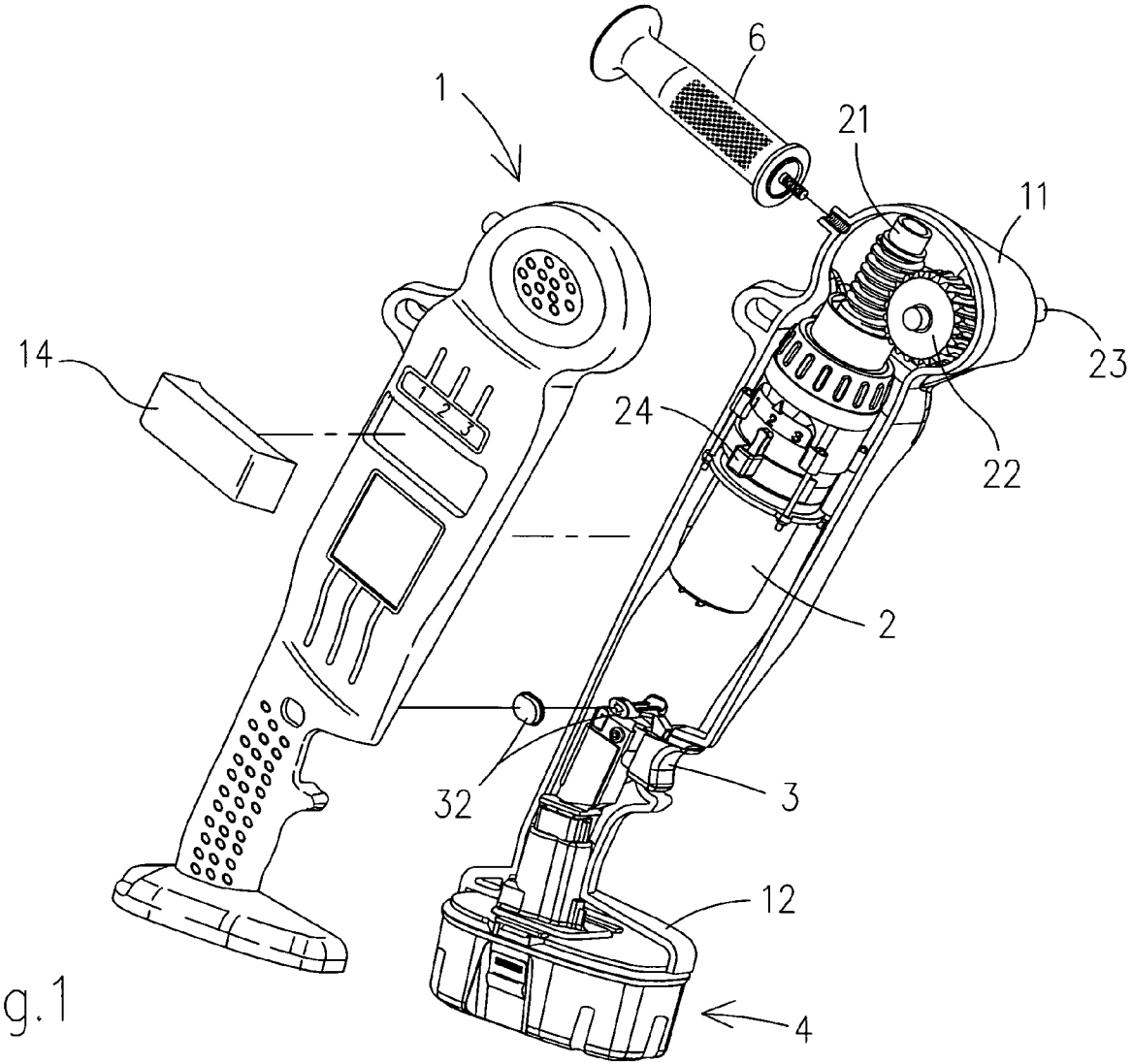
FIG. 1 is a first pictorially exploded view showing a chargeable electric winch according to the invention.
Figure 2:
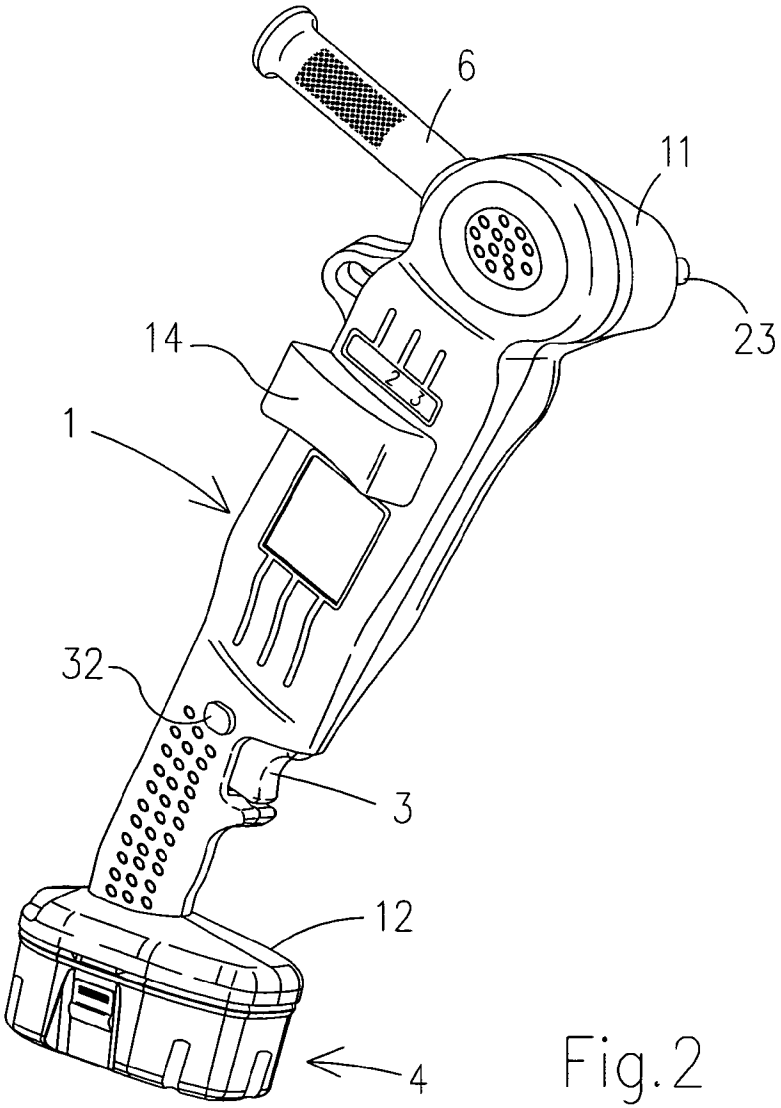
FIG. 2 is a pictorially assembled view showing the chargeable electric winch of FIG. 1 according to the invention.
Figure 3:
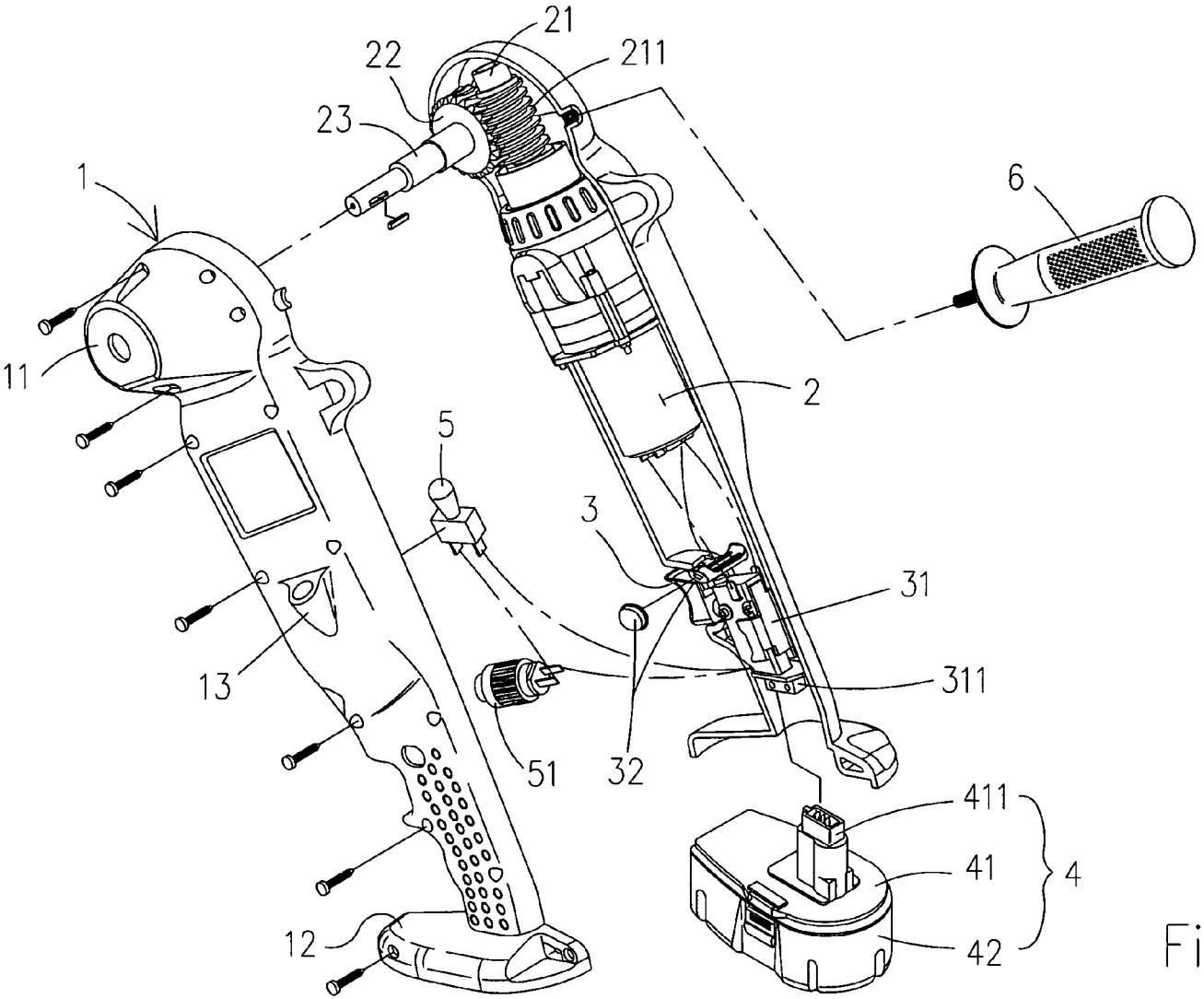
FIG. 3 is a second pictorially exploded view showing the chargeable electric winch according to the invention.
Figure 4:
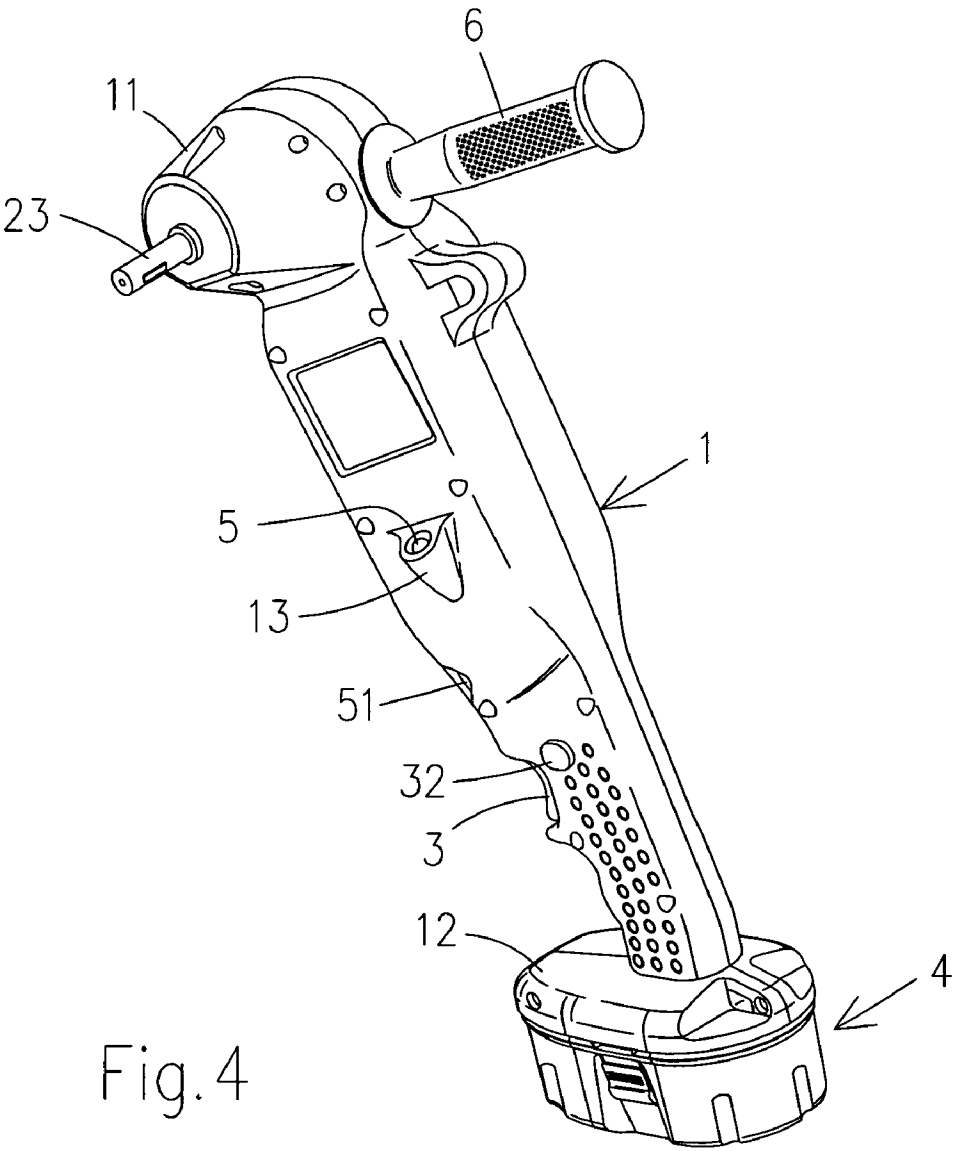
FIG. 4 is a pictorially assembled view showing the chargeable electric winch of FIG. 3 according to the invention.

Referring to FIGS. 1 to 4, a chargeable electric winch of the invention includes a housing 1, a driving device 2, a driven shaft 23, a first switch 3 and a battery 4. Preferably, the chargeable electric winch further includes a lighting element 5 and a handle 6.

The housing 1 has a first end portion 11, a second end portion 12 and an illumination base 13, and may further have a separatable protection cover 14 that may be closed. The illumination base 13 slantingly corresponds to the first end portion 11, and particularly corresponds to a free end of the driven shaft 23 extending out of the first end portion 11 so that the better illumination effect may be achieved.

The driven shaft 23 penetrates through the housing 1. One end of the driven shaft 23 is connected to a gear 22 and is thus driven by the driving device 2 to rotate. The other end of the driven shaft 23 extends out of the first end portion 11 of the housing 1 to form the free end.

The driving device 2 is disposed in the housing 1 and has an active rotating shaft 21, which has a ratchet portion 211. The gear 22 of the driven shaft 23 is engaged with the ratchet portion 211 of the active rotating shaft 21 and is thus driven to rotate. The driving device 2 further has a switching button 24 for switching between different gear ratios, and for electronically controlling the gear of the driving device 2 to achieve the function of changing the gear ratio. The switching button 24 is exposed out of the housing 1 and may be actuated to change the gear ratio.

The first switch 3 is disposed on the housing 1 and has a controller 31. The controller 31 is disposed in the housing 1 between the first and second end portions 11 and 12. The controller 31 has an opposite connector 311 and is further electrically connected to the driving device 2. In addition, the controller 31 of the first switch 3 further has a direction changing switch 32 for switching the rotation direction of the driving device 2. In addition, the direction changing switch 32 is exposed out of the housing 1. The first switch 3 mechanically controls the rotating speed of the driving device 2. The rotating speed is slower when the first switch 3 is slightly pressed, and is higher when the first switch 3 is heavily pressed. The lighting element 5 and a second switch 51 are disposed on the housing 1 and exposed out of the housing 1, and are further electrically connected to the opposite connector 311. The lighting element 5 is disposed on the illumination base 13 on the housing 1 in order to illuminate the free end of the driven shaft 23.

The battery 4 includes a battery supporting seat 41 on which an outer connector 411 is disposed, and a battery box 42 in which an inner battery body is disposed. The battery box 42 is combined with or engaged with the battery supporting seat 41. The outer connector 411 is electrically connected to the battery body so that the battery 4 for providing power can be electrically connected to the opposite connector 311 through the outer connector 411. The battery 4 further can be separatably assembled with the second end portion 12 of the housing 1 through its battery supporting seat 41 so that the battery 4 can be replaced with a new one.

The handle 6 is disposed on (fixed to or screwed to) the housing 1, and the position of the handle 6 is close to the driven shaft 23 so that the orientation of the free end of the driven shaft 23 can be controlled more conveniently and more precisely.

Figure 5:
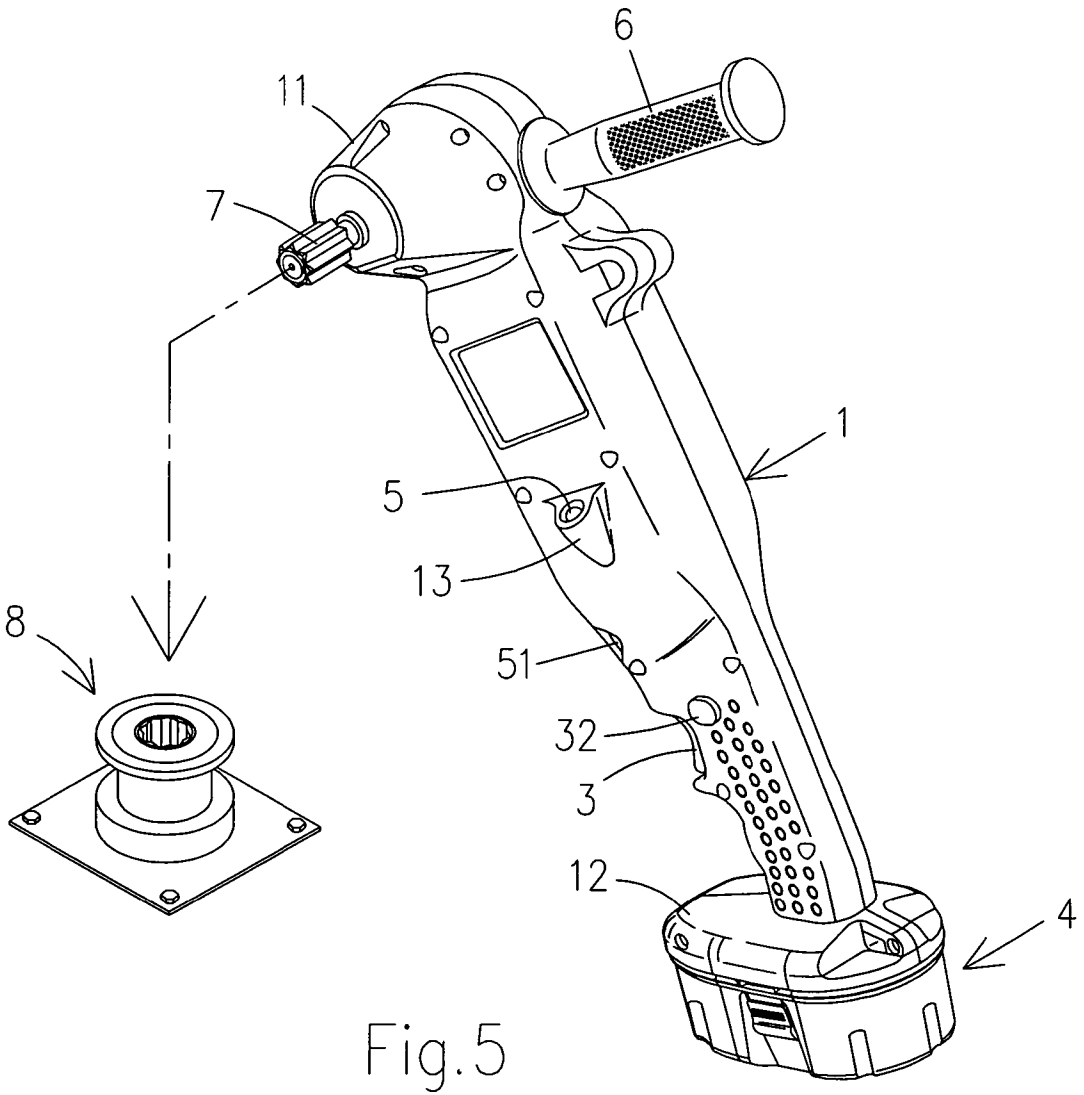
FIG. 5 is a schematic illustration showing a chargeable electric winch according to a first embodiment of the invention.
Figure 6:
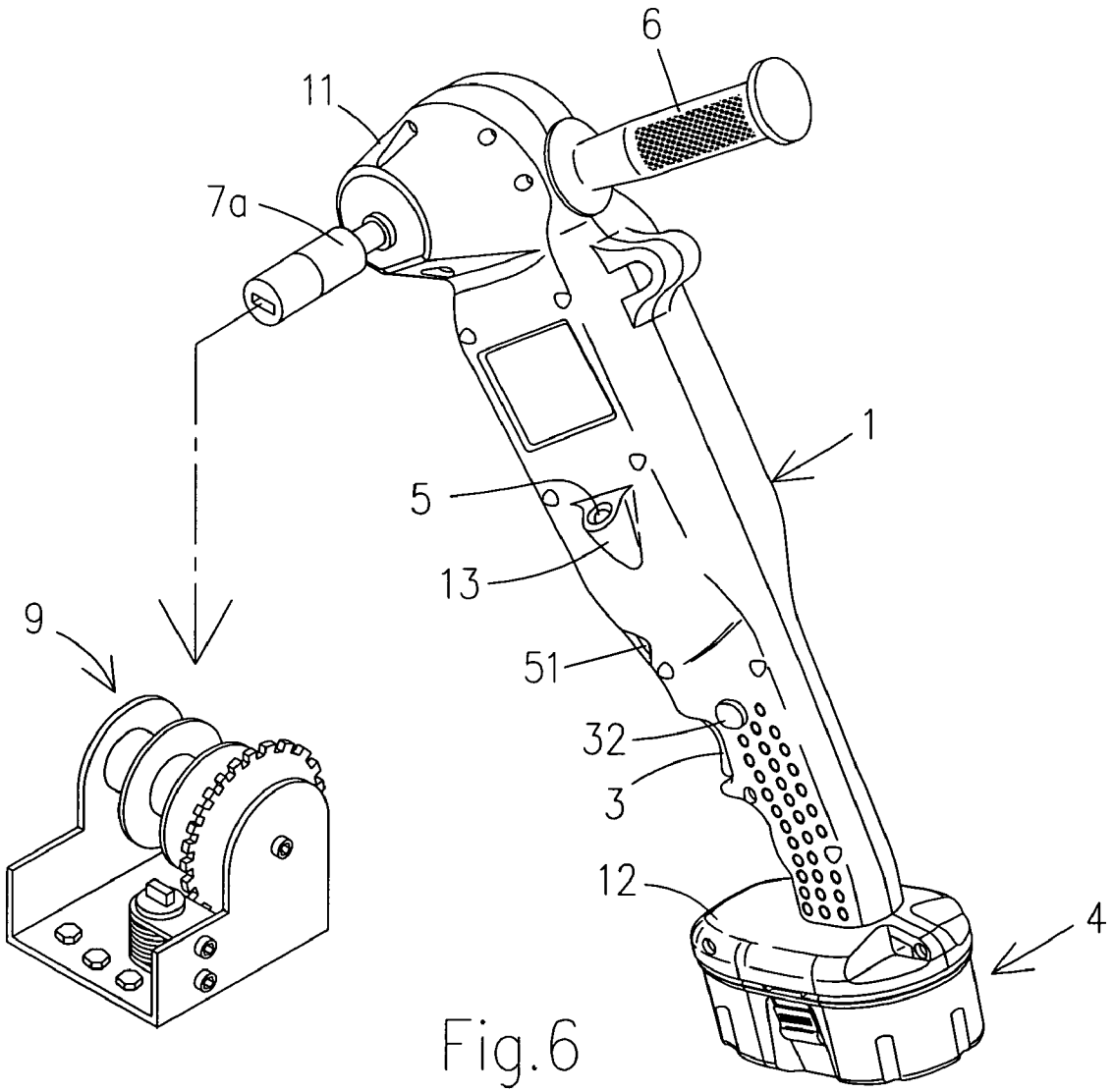
FIG. 6 is a schematic illustration showing a chargeable electric winch according to a second embodiment of the invention.

Referring to FIGS. 5 and 6, one end of the driven shaft 23 extends into the housing 1, and the free end of the driven shaft 23 is separatably assembled with an opposite element 7 or 7*a* to be combined with a first to-be-controlled object 8 or a second to-be-controlled object 9 so that the object 8 or 9 can be controlled to rotate. The first to-be-controlled object 8 is disposed on a deck of a sailing boat or a yacht to control the cable to be coiled and uncoiled, to control the canvas to be spread and pulled together and to change the moving direction of the canvas. The second to-be-controlled object 9 is disposed on the floor of the tennis court to lift up or lower down the net.

Figure 7:
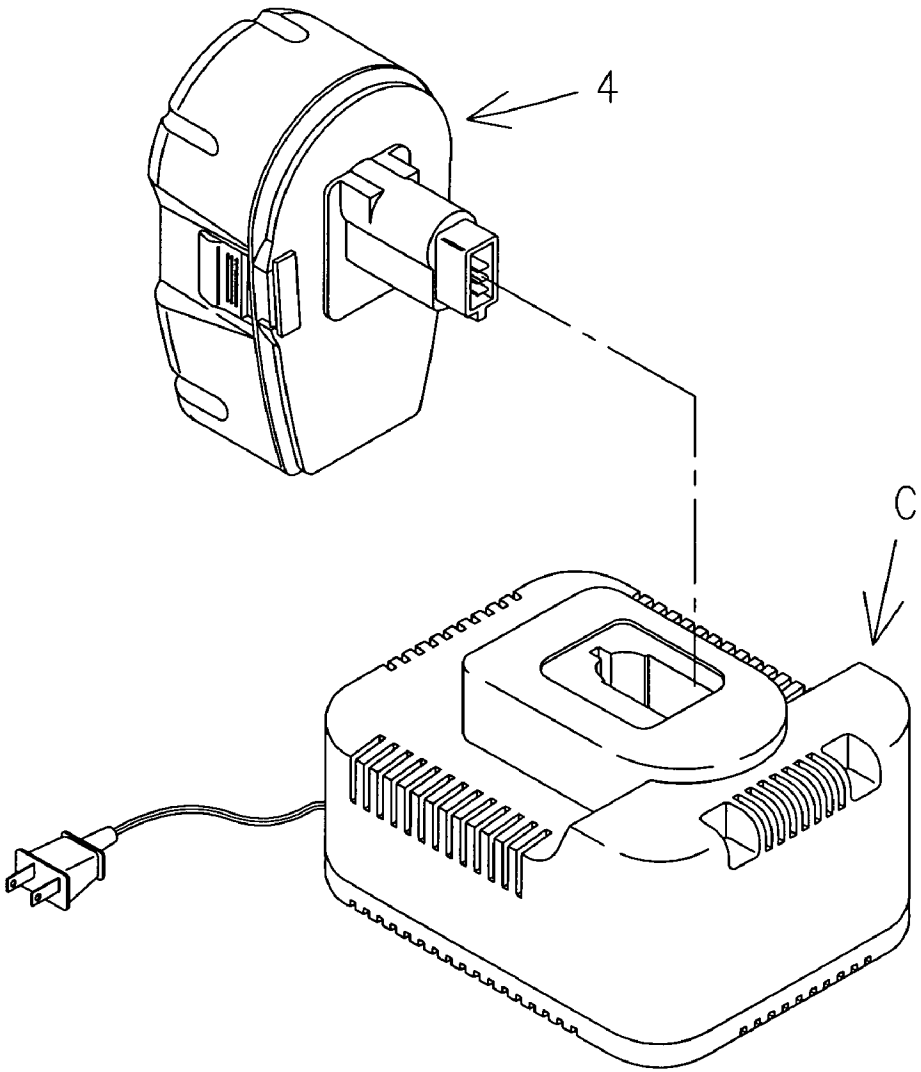
FIG. 7 is a schematic illustration showing a dedicated charger for charging a battery of the chargeable electric winch of the invention.

As shown in FIG. 7, the battery 4 is a chargeable battery that may be charged by a charger.

Thus, the electric winch of the invention has the following features and functions.

1. The electric winch of the invention is portable and can thus be carried and operated conveniently.

2. The electric winch of the invention is powered by the battery so that the electric winch can be used at a place where no power can be obtained or the power cannot be easily obtained, and the timesaving and laborsaving effects can be obtained as compared with the conventional manual winch.

3. The driven shaft 23 can be connected to different opposite elements 7 and 7*a* according to the actual requirement.

4. The light emitting angle of the lighting element 5 is configured such that the light is emitted toward the free end of the driven shaft 23. Thus, the better illumination effect may be obtained.

5. The position of the handle 6 is close to the driven shaft 23 so that the orientation of the free end of the driven shaft 23 can be controlled more conveniently and more precisely.

6. The battery 4 is configured to be separatably assembled with the second end portion 12 of the housing 1 so that the battery 4 can be replaced with another backup battery. More particularly, the connection between the outer connector 411 and the opposite connector 311 can achieve the effect of creating the electrical connection between the outer connector 411 and the opposite connector 311 when the battery 4 is assembled with the second end portion 12.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A chargeable electric winch for driving a to-be-controlled object to rotate, the electric winch comprising:

a housing;

a driving device disposed in the housing;

a driven shaft, which penetrates through the housing and is driven by the driving device to rotate;

wherein the driving device has an active rotating shaft, one end of the driven shaft is connected to a gear, the active rotating shaft has a ratchet portion, the gear of the driven shaft is engaged with the ratchet portion of the active rotating shaft and is driven to rotate, and a free end of the driven shaft is disposed outside the housing, said driven shaft being generally perpendicular to said rotating shaft of said driving device;

a first switch, which is disposed on the housing and has a controller, wherein the controller has an opposite connector and is further electrically connected to the driving device; and a battery having an inner battery body and an outer connector electrically connected to the battery body, wherein the battery for providing power is electrically connected to the opposite connector of the first switch through the outer connector of the battery, and the battery is separatably assembled with the housing.

2. The chargeable electric winch according to claim 1, wherein the battery comprises a battery supporting seat on which the outer connector is disposed, and a battery box in which the battery body is disposed, the battery box is combined with the battery supporting seat, and the battery supporting seat is separatably assembled with the housing.

3. The chargeable electric winch according to claim 1, wherein the driving device has a switching button exposed out of the housing.

4. The chargeable electric winch according to claim 1, wherein the first switch has a direction changing switch for switching a rotation direction of the driving device, and the direction changing switch is exposed out of the housing.

5. The chargeable electric winch according to claim 1, further comprising a lighting element and a second switch, both of which are disposed on the housing and exposed out of the housing, and are electrically connected to the opposite connector.

6. The chargeable electric winch according to claim 5, wherein the housing is further formed with an illumination base configured to illuminate the driven shaft, and the lighting element is disposed in the illumination base.

7. The chargeable electric winch according to claim 1, further comprising a handle disposed on the housing.

8. The chargeable electric winch according to claim 1, wherein one end of the driven shaft extends into the housing, a free end of the driven shaft is separatably combined with an opposite element, and the opposite element can be combined with the to-be-controlled object to control the to-be-controlled object to rotate.

9. The chargeable electric winch according to claim 1, wherein the battery is a chargeable battery, which may be charged by a charger.

10. The chargeable electric winch according to claim 1, wherein the first switch mechanically controls a rotating speed of the driving device.

* * * * *